US008735038B2

(12) United States Patent
Kunii et al.

(10) Patent No.: US 8,735,038 B2
(45) Date of Patent: May 27, 2014

(54) TONER FOR NON-CONTACT FUSING

(71) Applicant: Kao Corporation, Chuo-ku (JP)

(72) Inventors: Satoshi Kunii, Wakayama (JP); Masahito Yamazaki, Wakayama (JP); Takashi Kubo, Wakayama (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 13/644,025

(22) Filed: Oct. 3, 2012

(65) Prior Publication Data

US 2013/0029263 A1 Jan. 31, 2013

Related U.S. Application Data

(62) Division of application No. 12/434,158, filed on May 1, 2009, now Pat. No. 8,367,291.

(30) Foreign Application Priority Data

May 9, 2008 (JP) ..... 2008-123586

(51) Int. Cl.
*G03G 9/087* (2006.01)

(52) U.S. Cl.
USPC ..... 430/109.4

(58) Field of Classification Search
USPC ..... 430/109.4, 108.1
See application file for complete search history.

(56) References Cited

U.S. PATENT DOCUMENTS

| | | | | |
|---|---|---|---|---|
| 5,079,123 | A | 1/1992 | Nanya et al. | |
| 5,395,726 | A | 3/1995 | Tavernier et al. | |
| 6,077,639 | A * | 6/2000 | Semura et al. | 430/109.4 |
| 6,383,705 | B2 | 5/2002 | Aoki et al. | |
| 6,509,130 | B1 | 1/2003 | Semura et al. | |
| 6,756,172 | B2 | 6/2004 | Ueno et al. | |
| 7,374,851 | B2 | 5/2008 | Nakayama et al. | |
| 7,521,164 | B2 | 4/2009 | Nakayama et al. | |
| 7,587,161 | B2 | 9/2009 | Yamada et al. | |
| 7,820,354 | B2 * | 10/2010 | Shirai | 430/137.2 |
| 8,071,268 | B2 | 12/2011 | Shirai et al. | |
| 2004/0131962 | A1 * | 7/2004 | Nakamura et al. | 430/108.21 |
| 2005/0064310 | A1 | 3/2005 | Masuda et al. | |
| 2006/0046173 | A1 | 3/2006 | Sakai et al. | |
| 2006/0063092 | A1 | 3/2006 | Hasegawa et al. | |
| 2008/0220360 | A1 * | 9/2008 | Hasegawa | 430/109.3 |

FOREIGN PATENT DOCUMENTS

| | | | | |
|---|---|---|---|---|
| CN | 1734370 | A | 2/2006 | |
| CN | 1853143 | A | 10/2006 | |
| JP | 3-3936 | | 1/1991 | |
| JP | 4-338973 | | 11/1992 | |
| JP | 8-20636 | | 1/1996 | |
| JP | 8-30027 | | 2/1996 | |
| JP | 10-239903 | | 9/1998 | |
| JP | 11-133668 | | 5/1999 | |
| JP | 3003936 | | 11/1999 | |
| JP | 2003-29460 | | 1/2003 | |
| JP | 2003-149865 | | 5/2003 | |
| JP | 3415909 | | 6/2003 | |
| JP | 2006-47879 | | 2/2006 | |
| WO | 2005/103833 | * | 11/2005 | G03G 9/087 |

OTHER PUBLICATIONS

Office Action issued on Aug. 31, 2011 in the corresponding Chinese Patent Application No. 200910140429.X (with English translation).

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A toner for non-contacting fusing containing toner matrix particles containing a resin binder and an external additive having an average particle size of from 10 to 100 nm, wherein the external additive is externally added to the toner matrix particles, wherein the resin binder contains one or more polyesters, wherein a carboxylic acid component of the polyester contains one or more isophthalic acid compounds and one or more fumaric acid/maleic acid compounds, wherein the isophthalic acid compound is contained in an amount of from 10 to 35% by weight, the fumaric acid/maleic acid compound is contained in an amount of from 1 to 15% by weight, and the isophthalic acid compound and the fumaric acid/maleic acid compound are contained in a total amount of from 20 to 36% by weight, of a total amount of the entire raw material monomers of the polyester in the resin binder, and wherein the toner has a softening point of from 90° to 120° C. The toner is suitably used in developing latent images formed in, for example, electrophotography, an electrostatic recording method, an electrostatic printing method, or the like.

15 Claims, No Drawings

TONER FOR NON-CONTACT FUSING

This is a divisional application of U.S. application Ser. No. 12/434,158, filed May 1, 2009.

FIELD OF THE INVENTION

The present invention relates to a toner for non-contact fusing usable in developing latent images formed in, for example, electrophotography, an electrostatic recording method, an electrostatic printing method, or the like.

BACKGROUND OF THE INVENTION

In recent years, with the growth of the print-on-demand market, the demands for speeding up electrophotographic techniques are all the more increasing. In view of the above, as a means for meeting the requirement of speeding up, a toner that is capable of fixing at a low temperature is studied in order to fix the toner on paper with less energy. For example, a toner having excellent low-temperature fixing ability by containing a linear low-softening point polyester as a resin binder (see JP-B-3003936 (U.S. Pat. No. 5,079,123), JP-B-3415909 (U.S. Pat. No. 5,395,726), and the like); a method for producing a toner including the step of melt-kneading under specified conditions, using a resin binder containing a polyester having a softening point of from 90° to 110° C. and a low-melting point wax having a melting point of from 60° to 90° C. (see JP-A-2006-47879, and the like); and the like are proposed.

Further, a toner is scattered by speeding up, thereby making it more likely to generate the phenomenon of staining inside the machine; therefore, in order to obtain a high triboelectric chargeability, a polyester obtained from an aromatic monomer such as terephthalic acid as a raw material monomer for a resin binder is widely used. In addition, with the speeding up, although mechanical stress applied to a toner also increases, the glass transition temperature of the polyester becomes high by using the above aromatic monomer, thereby also increasing durability (see JP-A-2003-149865, and the like).

On the other hand, in order to satisfy both low-temperature fixing ability and storage stability of the toner, JP-A-2003-29460 proposes a method for producing a toner including the step of melt-kneading at a specified temperature a resin binder containing a crystalline polyester, a polyester having a softening point of from 120° to 170° C., a glass transition temperature of from 58° to 75° C., and a percentage of chloroform-insoluble components of from 5 to 50% by mass, and a polyester having a softening point of from 90° to 120° C., a glass transition temperature of from 58° to 75° C., and a percentage of chloroform-insoluble components of less than 5% by mass, and the publication discloses a toner containing a polyester of which raw material monomer is isophthalic acid, and a polyester of which raw material monomer is fumaric acid. In addition, in order to exhibit high gloss, JP-A-Hei-4-338973 proposes a toner containing a first nonlinear polyester having a softening point of 105° C. or more and less than 120° C. and a second nonlinear polyester having a softening point of 80° C. or more and less than 105° C., and the publication discloses a toner containing a polyester in which the first polyester or the second polyester is a polyester of which raw material monomers are isophthalic acid and fumaric acid.

In addition, as a toner capable of maintaining high image qualities even for a long period of use, having very small influences therein even under both low-temperature, low-humidity and high-temperature, high-humidity environmental conditions, having high transparency, fixable at low temperatures, and capable of forming a smooth fixing surface, JP-A-Hei-8-30027 proposes a toner in which a resin binder is a linear polyester, and the resin binder has a pulverizability index of from 14 to 40, and the publication discloses a toner containing a polyester of which raw material monomers are isophthalic acid and fumaric acid.

However, the isophthalic acid monomer in these toners is used in a ratio of only a small amount of less than 8% by weight of the entire raw material monomers for the polyester in the toner.

SUMMARY OF THE INVENTION

The present invention relates to a toner for non-contacting fusing containing (a) toner matrix particles containing a resin binder and (b) an external additive having an average particle size of from 10 to 100 nm, wherein the external additive is externally added to the toner matrix particles, wherein the resin binder contains one or more polyesters, wherein a carboxylic acid component of the polyester contains (i) one or more isophthalic acid compounds selected from the group consisting of isophthalic acid and esters thereof and (ii) one or more fumaric acid/maleic acid compounds selected from the group consisting of fumaric acid, maleic acid, maleic anhydride, and esters thereof, wherein the isophthalic acid compound is contained in an amount of from 10 to 35% by weight, the fumaric acid/maleic acid compound is contained in an amount of from 1 to 15% by weight, and the isophthalic acid compound and the fumaric acid/maleic acid compound are contained in a total amount of from 20 to 36% by weight, of the total amount of the entire raw material monomers of the polyester in the resin binder, and wherein the toner has a softening point of from 90° to 120° C.

DETAILED DESCRIPTION OF THE INVENTION

The present invention relates to a toner for non-contact fusing, having low-temperature fixing ability and durability that are durable for use in a non-contact fusing device and providing excellent transferability even in a non-contact fusing method, thereby making it possible to maintain a stable image density even in the formation of fixed images at high speeds.

The toner for non-contact fusing of the present invention has excellent effects that the toner has excellent low-temperature fixing ability and durability and provides excellent transferability even in a non-contact fusing method, thereby making it possible to maintain a stable image density in the formation of fixed images at high speeds.

These and other advantages of the present invention will be apparent from the following description.

In conventionally known toners, while low-temperature fixing ability in a non-contact fusing method can be satisfied, transferability is not sufficient, so that an image density is likely to be lowered.

A great feature of the toner for non-contact fusing of the present invention resides in that the toner contains toner matrix particles containing a specified resin binder and a specified external additive being externally added to the toner matrix particles, wherein the resin binder contains one or more polyesters, wherein a carboxylic acid component of the polyester contains in specified amounts of each of one or more compounds selected from the group consisting of isophthalic acid and esters thereof (hereinafter also referred to as "isophthalic acid compound") and one or more compounds selected from the group consisting of fumaric acid, maleic acid, maleic anhydride, and esters thereof (hereinafter also referred to as "fumaric acid/maleic acid compound").

If isophthalic acid is used in the carboxylic acid component, the reactivity with the alcohol component is excellent, so that the residual monomers can be dramatically reduced. On the other hand, as in a conventional case, if a polyester having a low-softening point that can meet the demand for the non-contact fusing method is synthesized using terephthalic acid, from the viewpoint of triboelectric chargeability, the reactivity with terephthalic acid and the alcohol component is low, so that a low-molecular weight component such as a monomer or an oligomer remains, thereby leading the lowering of elasticity of the resin. If the elasticity of the resin is lowered, in a high-speed apparatus for forming fixed images in which a large stress is applied to a toner, an external additive is easily embedded in the toner, so that transferability is worsened, and image density is also lowered.

However, if only a polyester obtained by using an aromatic carboxylic compound such as isophthalic acid as a carboxylic acid component is used, low-temperature fixing ability becomes insufficient because of a rigid molecular backbone of the polyester. Therefore, in the present invention, a fumaric acid/maleic acid compound is further used as the carboxylic acid component of the polyester. The isophthalic acid compound and the fumaric acid/maleic acid compound mentioned above are used in specified amounts, whereby the properties of the toner such as low-temperature fixing ability, transferability, image density and durability can be improved.

The ester of isophthalic acid in the isophthalic acid compound and the ester of fumaric acid and maleic acid in the fumaric acid/maleic acid compound include lower alkyl (1 to 6 carbon atoms) esters thereof, and the like.

The isophthalic acid compound and the fumaric acid/maleic acid compound may be used as carboxylic acid components of different polyesters (a first embodiment), or they may be used as a carboxylic acid component of the same polyester (a second embodiment), and the first embodiment is preferable, from the viewpoint of improving durability of the toner.

The first embodiment of the present invention is a toner containing a resin binder containing a polyester A obtained by polycondensing a carboxylic acid component containing one or more members selected from the group consisting of isophthalic acid and esters thereof, and an alcohol component, and a polyester B obtained by polycondensing a carboxylic acid component containing one or more members selected from the group consisting of fumaric acid, maleic acid, maleic anhydride, and esters thereof, and an alcohol component.

The isophthalic acid compound in the polyester A is contained in an amount of preferably 50% by mol or more, more preferably 70% by mol or more, and even more preferably 90% by mol or more, of the carboxylic acid component, from the viewpoint of improving transfer efficiency. Here, a terephthalic acid compound, i.e. terephthalic acid and/or terephthalic ester, is contained in an amount of preferably 10% by mol or less, more preferably 5% by mol or less, and even more preferably 2% by mol or less, of the carboxylic acid component, from the viewpoint of improving transfer efficiency, and it is even more preferable that the terephthalic acid compound is not contained. In addition, it is preferable that the fumaric acid/maleic acid compound is not contained in the carboxylic acid component, from the viewpoint of increasing reactivity of isophthalic acid and improving transfer efficiency. If contained, the fumaric acid/maleic acid compound is contained in an amount of preferably 5% by mol or less, of the carboxylic acid component.

In addition, the fumaric acid/maleic acid compound in the polyester B is contained in an amount of preferably 50% by mol or more, more preferably 70% by mol or more, and even more preferably 90% by mol or more, of the carboxylic acid component, from the viewpoint of improving low-temperature fixing ability. Here, the isophthalic acid compound is preferably not contained, from the viewpoint of improving low-temperature fixing ability. If contained, it is preferable that the isophthalic acid compound is contained in an amount of 5% by mol or less, of the carboxylic acid component.

Here, the polyester A has an acid value of preferably less than 6 mg KOH/g, and more preferably less than 4 mg KOH/g, from the viewpoint of maintaining stable triboelectric chargeability even under various environmental conditions such as high temperatures and high humidity.

The polyester A and the polyester B in the resin binder are preferably in a weight ratio, i.e. the polyester A/the polyester B, of from 90/10 to 50/50, and more preferably from 80/20 to 60/40, from the viewpoint of low-temperature fixing ability and durability.

A second embodiment of the present invention is a toner containing a resin binder containing a polyester C obtained by polycondensing a carboxylic acid component containing an isophthalic acid compound and a fumaric acid/maleic acid compound, and an alcohol component.

The isophthalic acid compound is contained in the polyester C in an amount of preferably 50% by mol or more, more preferably 60% by mol or more, and even more preferably 70% by mol or more, of the carboxylic acid component, from the viewpoint of improving transfer efficiency.

In addition, the fumaric acid/maleic acid compound in the polyester C is contained in an amount of preferably from 20 to 70 mol, more preferably from 30 to 60 mol, and even more preferably from 40 to 50 mol, based on 100 mol of the isophthalic acid compound, from the viewpoint of improving transfer efficiency and low-temperature fixing ability.

The polyester is obtained by polycondensing raw material monomers of an alcohol component and a carboxylic acid component, such as a carboxylic acid, a carboxylic acid anhydride, or a carboxylic acid ester.

The alcohol component of the polyester includes an alkylene oxide adduct of bisphenol A represented by the formula (I):

(I)

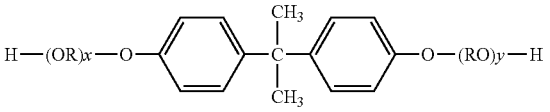

wherein RO and OR are oxyalkylene groups, wherein R is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4;

ethylene glycol, propylene glycol, glycerol, pentaerythritol, trimethylolpropane, hydrogenated bisphenol A, sorbitol, or alkylene (2 to 4 carbon atoms) oxide (number of moles in average: 1 to 16) adducts thereof; and the like.

Among them, the alkylene oxide adduct of bisphenol A represented by the formula (I) is preferred, from the viewpoint of durability and triboelectric chargeability of the toner, and a propylene oxide adduct of bisphenol A where R is a propylene group in the formula (I) is more preferred, from the viewpoint of increasing storage modulus at 50° C., thereby preventing an external additive from being embedded.

The alkylene oxide adduct of bisphenol A represented by the formula (I) is contained in an amount of preferably 5% by mol or more, more preferably 50% by mol or more, and even more preferably substantially 100% by mol, of the alcohol component, from the viewpoint of improving transfer efficiency. The propylene oxide adduct of bisphenol A where R is a propylene group in the formula (I) is contained in an amount of preferably from 10 to 100% by mol, and more preferably from 20 to 100% by mol, of a total amount of the alkylene oxide adduct of bisphenol A represented by the formula (I).

In addition, the carboxylic acid component other than the isophthalic acid compound and the fumaric acid/maleic acid compound includes dicarboxylic acids such as phthalic acid, terephthalic acid, adipic acid, and succinic acid; succinic acids substituted with an alkyl group having 1 to 20 carbon atoms or an alkenyl group having 2 to 20 carbon atoms, such as dodecenylsuccinic acid and octenylsuccinic acid; tricarboxylic or higher polycarboxylic acids such as trimellitic acid and pyromellitic acid; acid anhydrides thereof and alkyl(1 to 8 carbon atoms) esters of these acids; and the like.

In addition, the alcohol component may properly contain a monohydric alcohol, and the carboxylic acid component may properly contain a monocarboxylic acid compound, from the viewpoint of adjusting its molecular weight, and the like.

In the present invention, it is preferable that all of the polyesters A to C are linear polyesters, from the viewpoint of low-temperature fixing ability. In the present invention, the linear polyester refers to a polyester containing a trivalent or higher polyvalent monomer, i.e. a trihydric or polyhydric alcohol and/or a tricarboxylic or higher polycarboxylic acid compound, in an amount of less than 1% by mol of a total amount of the carboxylic acid component and the alcohol component, and it is preferred that the trivalent or higher polyvalent monomer is not substantially contained. On the other hand, a nonlinear polyester refers to a polyester containing a trivalent or higher polyvalent monomer in an amount of 1% by mol or more of a total amount of the carboxylic acid component and the alcohol component. It is preferable that the resin binder of the toner of the present invention does not contain a nonlinear polyester, from the viewpoint of improving the low-temperature fixing ability of the toner.

The polyester is obtained by, for example, polycondensing an alcohol component and a carboxylic acid component in an inert gas atmosphere at a temperature of 180° to 250° C., using, if necessary, an esterification catalyst.

Each of the polyesters A to C has a softening point of preferably 90° C. or more, more preferably 95° C. or more, and even more preferably 100° C. or more, from the viewpoint of improving durability of the toner. In addition, each polyester has a softening point of preferably 120° C. or less, more preferably 115° C. or less, and even more preferably 110° C. or less, from the viewpoint of improving the low-temperature fixing ability of the toner. In other words, if these viewpoints are taken comprehensively, each polyester has a softening point of preferably from 90° to 120° C., more preferably from 95° to 115° C., and even more preferably from 100° to 110° C. It is preferable that the entire resin binder has a softening point within the above range.

Each of the polyesters A to C has a glass transition temperature of preferably 50° C. or more, and more preferably 55° C. or more, from the viewpoint of improving durability of the toner. In addition, each polyester has a glass transition temperature of preferably 85° C. or less, and more preferably 80° C. or less, from the viewpoint of improving low-temperature fixing ability of the toner. In other words, if these viewpoints are taken comprehensively, each polyester has a glass transition temperature of preferably from 50° to 85° C., and more preferably from 55° to 80° C. Here, the glass transition temperature is a physical property peculiarly owned by an amorphous resin, which may not be measured for a crystalline resin, but the polyester in the present invention may be a crystalline polyester.

In both the softening point and the glass transition temperature, in a case where the polyester contains plural polyesters as in the first embodiment mentioned above, it is preferable that a weighed average thereof is within the above-mentioned range.

Here, in the present invention, the polyester may be a modified polyester to an extent that its properties are not substantially impaired. The modified polyester refers to a grafted or blocked polyester with phenol, urethane, epoxy, or the like, in accordance with the methods described in, for example, JP-A-Hei-11-133668, JP-A-Hei-10-239903, JP-A-Hei-8-20636, and the like.

The polyesters A and B are contained in a total amount of, or the polyester C is contained in an amount of, preferably from 70 to 100% by weight, and more preferably substantially 100% by weight, of the resin binder, from the viewpoint of improving low-temperature fixing ability and transfer efficiency.

In the polyester (in the first embodiment, the polyester A, the polyester B, and the polyester other than the polyester A and the polyester B; in the second embodiment, the polyester C and the polyester other than the polyester C) of the resin binder, the isophthalic acid compound is contained in an amount of 10% by weight or more, preferably 15% by weight or more, more preferably 20% by weight or more, of a total amount of the raw material monomers for all the polyesters, specifically, a total amount of carboxylic acid component monomers and alcohol component monomers, from the viewpoint of improving transferability and image density of the toner. Also, the isophthalic acid compound is contained in an amount of 35% by weight or less, preferably 30% by weight or less, and more preferably 25% by weight or less, of a total amount of the raw material monomers for all the polyesters, from the viewpoint of improving low-temperature fixing ability. Specifically, if these viewpoints are taken comprehensively, the isophthalic acid compound is contained in an amount of from 10 to 35% by weight, preferably from 15 to 30% by weight, and more preferably from 20 to 25% by weight.

In addition, the fumaric acid/maleic acid compound is contained in an amount of 1% by weight or more, preferably 3% by weight or more, and more preferably 5% by weight or more, of a total amount of the raw material monomers for all the polyesters, from the viewpoint of improving low-temperature fixing ability of the toner. Also, the fumaric acid/maleic acid compound is contained in an amount of 15% by weight or less, preferably 13% by weight or less, and more preferably 10% by weight or less, of a total amount of the raw material monomers for all the polyesters, from the viewpoint of improving transferability and durability of the toner. Specifically, if these viewpoints are taken comprehensively, the fumaric acid/maleic acid compound is contained in an amount of from 1 to 15% by weight, preferably from 3 to 12% by weight, and more preferably from 5 to 10% by weight.

In addition, the isophthalic acid compound and the fumaric acid/maleic acid compound are contained in a total amount of from 20 to 36% by weight, preferably from 25 to 33% by weight, and more preferably from 28 to 31% by weight, of a total amount of the raw material monomers for all the polyesters, from the viewpoint of satisfying all of low-temperature fixing ability, transferability, image density, and durability.

In the present invention, a resin binder may properly contain a polyester other than the above-mentioned polyesters A to C and other resin binders to an extent that the effects of the present invention would not be impaired. Other resin binders include vinyl resins, epoxy resins, polycarbonates, polyurethanes, and the like.

It is preferable that the toner of the present invention contains a colorant, a wax, a charge control agent, and the like.

As the colorant, all of dyes, pigments, and the like which are used as colorants for a toner can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazoyellow, and the like can be used. The colorant is contained in an amount of preferably from 1 to 40 parts by weight, and more preferably from 2 to 10 parts by weight, based on 100 parts by weight of the resin binder. The toner of the present invention may be any of black toners and color toners.

The wax includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof, ester waxes such as carnauba wax, montan wax, and sazole wax, and deacidified waxes thereof, and fatty acid ester waxes; fatty acid amides, fatty acids, higher alcohols, metal salts of fatty acids, and the like. Among them, the aliphatic hydrocarbon waxes and the ester waxes are preferable, from the viewpoint of improving releasing property and stability; the ester waxes are more preferable, and the carnauba wax is even more preferable, from the viewpoint of improving fixing ability. These waxes may be contained alone or in a mixture of two or more kinds.

The wax has a melting point of preferably from 60° to 100° C., more preferably from 70° to 95° C., and even more preferably from 80° to 90° C., from the viewpoint of improving low-temperature fixing ability of the toner and dispersibility of the colorant.

The wax is contained in an amount of preferably 4 parts by weight or less, more preferably from 0.5 to 3 parts by weight, and even more preferably from 1 to 2.5 parts by weight, based on 100 parts by weight of the resin binder, from the viewpoint of improving durability of the carrier.

The charge control agent is not particularly limited. The negatively chargeable charge control agent includes metal-containing azo dyes, for example, "VARIFAST BLACK 3804," "BONTRON S-31" (hereinabove commercially available from Orient Chemical Co., Ltd.), "T-77" (commercially available from Hodogaya Chemical Co., Ltd.), "BONTRON S-32," "BONTRON S-34," "BONTRON S-36" (hereinabove commercially available from Orient Chemical Co., Ltd.), "AIZEN SPILON BLACK TRH" (commercially available from Hodogaya Chemical Co., Ltd.), and the like; copper phthalocyanine dyes; metal complexes of alkyl derivatives of salicylic acid, for example, "BONTRON E-81," "BONTRON E-82," "BONTRON E-84," "BONTRON E-85" (hereinabove commercially available from Orient Chemical Co., Ltd.), and the like; nitroimidazole derivatives; boron complexes of benzilic acid, for example, "LR-147" (commercially available from Japan Carlit, Ltd.); and the like. Among them, the metal-containing azo dyes and the metal complexes of alkyl derivatives of salicylic acid are preferable, and the metal-containing azo dyes are more preferable, from the viewpoints of the triboelectric stability and the environmental stability.

The positively chargeable charge control agent includes Nigrosine dyes, for example, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.), and the like; triphenylmethane-based dyes containing a tertiary amine as a side chain, quaternary ammonium salt compounds, for example, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PX VP435" (commercially available from Clariant GmbH), and the like; polyamine resins, for example, "AFP-B" (commercially available from Orient Chemical Co., Ltd.), and the like; and imidazole derivatives, for example, "PLZ-2001," "PLZ-8001" (hereinabove commercially available from Shikoku Kasei K.K.), and the like. Among them, the Nigrosine dyes and the triphenylmethane-based dyes are preferable, and the Nigrosine dyes are more preferable, from the viewpoint of dispersibility and stability of triboelectric charges of the toner.

The charge control agent is contained in an amount of preferably from 0.3 to 5 parts by weight, and more preferably from 0.5 to 3 parts by weight, based on 100 parts by weight of the resin binder, from the viewpoint of giving the toner triboelectric chargeability.

The toner of the present invention may appropriately further be subjected to an internal addition or external addition of an additive such as a fluidity improver, an electric conductivity modifier, an extender, a reinforcing filler such as a fibrous substance, an antioxidant, an anti-aging agent, or a cleanability improver.

The method for producing toner matrix particles may be any of known methods such as a kneading-pulverization method, an emulsion phase-inversion method, and a polymerization method, and the kneading-pulverization method is preferred because the production is facilitated. For example, in the case of a pulverized toner produced by the kneading-pulverization method, toner matrix particles can be produced by homogeneously mixing a resin binder, a charge control agent, a colorant, a wax, and the like with a mixer such as a Henschel mixer, thereafter melt-kneading the mixture with a closed kneader, a single-screw or twin-screw extruder, or the like, cooling, pulverizing, and classifying the product. At least an external additive having an average particle size of from 10 to 100 nm is externally added to the resulting toner matrix particles, whereby a toner of the present invention is obtained.

The external additive has an average particle size of from 10 to 100 nm, from the viewpoint of improving transferability, preventing detachment, and inhibiting aggregation of the toner, and the external additives may be used alone in a combination of two or more kinds.

In a case where two kinds of external additives are used in a combination, it is preferable that an external additive having an average particle size of from 10 nm or more and less than 30 nm (smaller external additive) and an external additive having an average particle size of from 30 to 100 nm (larger external additive) are used in a combination, from the viewpoint of providing fluidity and preventing the external additive from being embedded. The smaller external additive and the larger external additive are in a weight ratio, i.e. smaller external additive/larger external additive, of preferably from 1/10 to 10/1, and more preferably from 1/5 to 5/1.

The external additive includes fine inorganic particles of silica, alumina, titania, zirconia, tin oxide, zinc oxide, and the like. Among them, silica having a small specific gravity is preferred, from the viewpoint of preventing the external additive from being embedded.

It is preferable that the silica is a hydrophobic silica which is subjected to a hydrophobic treatment, from the viewpoint of environmental stability. The method for hydrophobic treatment is not particularly limited, and the hydrophobic treatment agent includes hexamethyl disilazane (HMDS), dimethyl dichlorosilane (DMDS), silicone oil, methyl triethoxysilane, and the like. Among them, hexamethyl disilazane and dimethyl dichlorosilane are preferable. The amount treated by the hydrophobic treatment agent is preferably from 1 to 7 $mg/m^2$ per surface area of the fine inorganic particles.

The external additive having an average particle size of from 10 to 100 nm is contained in an amount of preferably from 0.1 to 5 parts by weight, and more preferably from 0.3 to 3 parts by weight, based on 100 parts by weight of the toner matrix particles. An external additive having an average particle size of less than 10 nm or an external additive having an average particle size exceeding 100 nm may be properly contained within the range that would not impair the effects of the present invention.

A mixer to be used upon mixing the toner matrix particles and the external additive is preferably an agitator used in dry blending, such as a high-speed agitator such as a Henschel mixer or a Super Mixer, or a V-type blender. The external additive may be previously mixed and added in a high-speed agitator or a V-type blender, or the external additives may be separately added.

The toner of the present invention has a volume-median particle size ($D_{50}$) of preferably from 3 to 15 μm, and more preferably from 4 to 10 μm, from the viewpoint of obtaining stable developability. The term "volume-median particle size ($D_{50}$)" as used herein means a particle size of which cumulative volume frequency calculated in the volume percentage accounts for 50% calculated from a smaller particle size.

The toner of the present invention contains a polyester in which isophthalic acid being highly reactive with an alcohol component and capable of dramatically reducing a residual monomer is used as a carboxylic acid component. By reducing the low-molecular weight component of the toner, the external additive can be prevented from being embedded because of the lowering of elasticity of the polyester. Therefore, the low-molecular weight component having a molecular weight of 1,000 or less, contained in the tetrahydrofuran-soluble component of the toner is contained in an amount of preferably 4.0% by weight or less, more preferably 3.8% by weight or less, and even more preferably 3.6% by weight or less, of the entire soluble component.

The tetrahydrofuran-soluble component of the toner has a number-average molecular weight of preferably 2,000 or more, and more preferably 2,500 or more, from the viewpoint of improving transfer efficiency, and the tetrahydrofuran-soluble component has a number-average molecular weight of preferably 5,000 or less, and more preferably 4,500 or less, from the viewpoint of improving low-temperature fixing ability. Specifically, if these viewpoints are taken comprehensively, the tetrahydrofuran-soluble component has a number-average molecular weight of preferably from 2,000 to 5,000, and more preferably from 2,500 to 4,500. In addition, from the same viewpoint, the tetrahydrofuran-soluble component has a weight-average molecular weight of preferably 8,000 or more, more preferably 9,000 or more, and the tetrahydrofuran-soluble component has a weight-average molecular weight of preferably 15,000 or less, and more preferably 14,000 or less. Specifically, if these viewpoints are taken comprehensively, the tetrahydrofuran-soluble component has a weight-average molecular weight of preferably from 8,000 to 15,000, and more preferably from 9,000 to 14,000.

The toner of the present invention has a storage modulus G' at 50° C. in a frequency of 6.28 rad/s of preferably from $3.0\times10^7$ to $3.0\times10^8$ Pa, more preferably from $3.5\times10^7$ to $1.0\times10^8$ Pa, and even more preferably from $4.0\times10^7$ to $8.0\times10^7$ Pa, from the viewpoint of satisfying both of prevention of the external additive of the toner in the developer device from being embedded, thereby maintaining a stable image density, and low-temperature fixing ability. The storage modulus of the toner can be adjusted with a raw material monomer of the resin binder or a low-molecular weight component of the toner.

The toner of the present invention has a softening point of 90° C. or more, preferably 95° C. or more, and more preferably 100° C. or more, from the viewpoint of improving durability of the toner, and the toner has a softening point of 120° C. or less, preferably 115° C. or less, and more preferably 110° C. or less, from the viewpoint of improving low-temperature fixing ability of the toner. Specifically, if these viewpoints are taken comprehensively, the toner has a softening point of from 90° to 120° C., preferably from 95° to 115° C., and more preferably from 100° to 110° C. In addition, the toner has a glass transition temperature of preferably 50° C. or more, and more preferably 55° C. or more, from the viewpoint of improving durability and storage stability of the toner, and the toner has a glass transition temperature of preferably 70° C. or less, and more preferably 65° C. or less, from the viewpoint of improving low-temperature fixing ability of the toner. Specifically, if these viewpoints are taken comprehensively, the toner has a glass transition temperature of preferably from 50° to 70° C., and more preferably from 55° to 65° C.

The toner of the present invention having excellent low-temperature fixing ability and favorable transferability is usable in an apparatus for forming fixed images according to a non-contact fusing method, such as oven fusing or flash fusing. The toner can be suitably used also in an apparatus for forming fixed image using a high speed having a linear speed of from 800 mm/sec or more, and preferably from 1000 to 3000 mm/sec. Here, the term "linear speed" refers to a processing speed for an apparatus for forming fixed images, which is determined by a paper-feeding speed at a fixing member. Incidentally, the toner of the present invention generates hot offset when used in an apparatus for forming fixed images according to a contact fusing method, so that the toner is not suitably used as a toner for contact fusing.

In addition, a method for development of the toner of the present invention is not particularly limited, and the toner can be suitably used also in an apparatus for forming fixed images according to a non-contact development method, because an external additive is less likely to be embedded in the toner surface, so that the toner has excellent triboelectric chargeability, transferability, and durability.

The toner of the present invention can be used directly as a toner for monocomponent development, or mixed with a carrier to prepare a two-component developer.

In the present invention, as the carrier, a carrier having a low saturation magnetization which has a weaker contact with substrates such as a photoconductor roller is preferable, from the viewpoint of the image properties. The carrier has a saturation magnetization of preferably from 40 to 100 $Am^2/kg$, and more preferably from 50 to 90 $Am^2/kg$. The carrier has a saturation magnetization of preferably 100 $Am^2/kg$ or less, from the viewpoint of controlling the hardness of the magnetic brush and retaining the tone reproducibility, and the carrier has a saturation magnetization of preferably 40 $Am^2/kg$ or more, from the viewpoint of preventing the carrier from being adhered and toner dust.

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, from the viewpoint of triboelectric chargeability.

The surface of the carrier can be coated with a resin, from the viewpoint of preventing the formation of toner scumming on the carrier. The resin for coating the surface of the carrier may vary depending upon the toner materials, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. These resins can be used alone or in a combination of two or more kinds. The method of coating a core material with a resin is not particularly limited, and includes, for example, a method of dissolving or suspending a coating material such as a resin in a solvent, and applying the solution or suspension to be deposited on a core material, a method of simply blending in the state of powder, and the like.

In a two-component developer obtained by mixing the toner with a carrier, the toner is contained in an amount of preferably from 0.5 to 10 parts by weight, and more preferably from 2 to 8 parts by weight, based on 100 parts by weight of the carrier, from the viewpoint of fluidity of the developer, and reduction of background fogging and generation of dust.

EXAMPLES

The following examples further describe and demonstrate embodiments of the present invention. The examples are given solely for the purposes of illustration and are not to be construed as limitations of the present invention.

[Softening Points (Tm) of Resins and Toners]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a sample is prepared by applying a load of 1.96 MPa thereto with the plunger and extruding a 1 g sample through a nozzle having a die pore size of 1 mm and a length of 1 mm, while heating the sample so as to raise the temperature at a rate of 6° C./min.

[Glass Transition Temperatures (Tg) of Resins and Toners]

The glass transition temperature refers to a temperature of an intersection of the extension of the baseline of equal to or lower than the temperature of the maximum endothermic peak and the tangential line showing the maximum inclination between the kick-off of the peak and the top of the peak, which is determined using a differential scanning calorimeter ("DSC 210," commercially available from Seiko Instruments, Inc.), by raising its temperature to 200° C., cooling the sample from this temperature to 0° C. at a cooling rate of 10° C./min, and thereafter raising the temperature of the sample at a heating rate of 10° C./min.

[Acid Values of Resins]

The acid values are measured as prescribed by a method of JIS K0070, provided that only a measurement solvent is changed from a mixed solvent of ethanol and ether as prescribed in JIS K0070 to a mixed solvent of acetone and toluene (acetone:toluene=1:1 (volume ratio))

[Melting Point of Waxes]

A temperature of maximum endothermic peak of the heat of fusion obtained by raising the temperature of a sample to 200° C. using a differential scanning calorimeter ("DSC 210," commercially available from Seiko Instruments, Inc.), cooling the sample from this temperature to 0° C. at a cooling rate of 10° C./min, and thereafter raising the temperature of the sample at a heating rate of 10° C./min, is referred to as a melting point.

[Volume-Median Particle Size ($D_{50}$) of Toners]

Measuring Apparatus Coulter Multisizer II (commercially available from Beckman Coulter, Inc.)

Aperture Diameter: 50 μm

Analyzing Software: Coulter Multisizer AccuComp Ver. 1.19 (commercially available from Beckman Coulter, Inc.)

Electrolytic Solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion.

Dispersion Conditions Ten milligrams of a measurement sample is added to 5 ml of the above dispersion, and the mixture is dispersed for 1 minute with an ultrasonic disperser, and 25 ml of an electrolytic solution is added to the dispersion, and further dispersed with an ultrasonic disperser for 1 minute, to prepare a sample dispersion.

Measurement Conditions The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

[Number-Average Molecular Weight (Mn), Weight-Average Molecular Weight (Mw), and Content of Low-Molecular Weight Component of Toners]

The number-average molecular weight and the weight-average molecular weight are obtained from the molecular weight distribution determined by the gel permeation chromatography (GPC) according to the following method.

(1) Preparation of Sample Solution

A toner is dissolved in tetrahydrofuran, so as to have a concentration of 0.5 g/100 ml. Each of the resulting solution is then filtered with a fluororesin filter ("FP-200," commercially available from Sumitomo Electric Industries, Ltd.) having a pore size of 2 μm to remove insoluble components, to provide a sample solution.

(2) Determination of Molecular Weights

Using the following measurement apparatus and analyzing column, tetrahydrofuran is allowed to flow as an eluate at a rate of 1 ml per minute, and the column is stabilized in a thermostat at 40° C. One-hundred microliters of the sample solution is injected to the column to determine a molecular weight. The molecular weight of the sample is calculated on the basis of a calibration curve previously prepared. The calibration curve of the molecular weight is prepared by using several kinds of monodisperse polystyrenes (A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$), each commercially available from Tosoh Corporation) as standard samples.

Measurement Apparatus: HLC-8220GPC (commercially available from Tosoh Corporation)

Analyzing Column: GMHLX+G3000HXL (commercially available from Tosoh Corporation)

The content of the low-molecular weight component having a molecular weight of 1,000 or less, contained in the tetrahydrofuran-soluble component contained in the toner is obtained from an integral value of the molecular weight distribution obtained by the above-mentioned measurement.

[Storage Modulus (G') of Toners]

The storage modulus is measured using a viscoelastometer (rheometer) Model RDA-III (commercially available from Rheometrics Scientific Inc.).

Measurement Jig: Parallel plates having a diameter of 25 mm are used.

Measurement Sample: 1 g of a toner

Measurement Conditions The measurement is started at 120° C., and the sample is cooled to 40° C. Thereafter, the sample is reheated from 40° to 160° C. The storage modulus at 50° C. upon this reheating is defined as G'(50). The conditions of the measurement apparatus are set as follows.

Geometry: Parallel Plates (25 mm)

Radius: 12.5 (mm)

Gap: Gap at 120° C.

The internal temperature of the measurement apparatus is raised to 120° C., and 1 g of a toner is then placed on the parallel plates. A molten toner is tightly adhered to the upper and lower plates. When Axal Force is 0, Gap is inputted.

1. Dynamic Mechanical Analysis
   Frequency/Temperature Sweep
2. Test Parameters
   Strain: 0.05(%)
   Initial Temperature: 40(° C.)
3. Sweep Parameters
   Sweep Type: Discrete
   Final temperature: 160(° C.)
   Step Size: 1(° C.)
   Soak Time: 30 (s)
   Frequency: 6.28 (rad/s)
4. Options
   Delay Before Test: 30 (s)
   Correlation Delay: 0.0 (Cycles)
   1 Cycle Correlation: No
   Auto tension: Yes

[Average Particle Size of External Additive]

The average particle size of the external additive refers to a number-average particle size, and particle sizes (an average of length and breadth) of 500 particles are measured from a photograph taken with a scanning electron microscope (SEM), and an average thereof is defined as an average particle size.

[Saturation Magnetization of Carrier]

(1) A carrier is filled in a plastic case with a lid with tapping, the case having an outer diameter of 7 mm (inner diameter of 6 mm) and a height of 5 mm. The mass of the carrier is determined from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, while vibrating the plastic case using the vibration function. The value obtained is calculated as the saturation magnetization per unit mass, taking into consideration the mass of the filled carrier.

Production Example 1 for Resins
[Resins A, D, and J]

A 5-liter four-neck flask equipped with a nitrogen inlet tube, a dehydration tube, a stirrer, and a thermocouple were charged with raw material monomers listed in Table 1 and 19.5 g of an esterification catalyst (dibutyltin oxide), and the components were heated to 230° C. and allowed to react until a reaction percentage reached 90%. Further, the reaction mixture was allowed to react at 8.3 kPa for 1 hour, to provide each of resins A, D, and J. Here, the reaction percentage as used in the present invention is a value obtained by the formula of [amount of reaction water (mol)/theoretical amount of generated water (mol)]×100.

Production Example 2 for Resins
[Resins B, G, and I]

A 5-liter four-neck flask equipped with a nitrogen inlet tube, a dehydration tube, a stirrer, and a thermocouple were charged with raw material monomers each listed in Table 1, 19.5 g of an esterification catalyst (dibutyltin oxide), and 2 g of hydroquinone (a polymerization inhibitor), and the components were heated to 230° C. and allowed to react until a reaction percentage reached 90%. Further, the reaction mixture was allowed to react at 8.3 kPa for 1 hour, to provide each of resins B, G, and I.

Production Example 3 for Resins [Resins C and H]

A 5-liter four-neck flask equipped with a nitrogen inlet tube, a dehydration tube, a stirrer, and a thermocouple were charged with BPA-PO, BPA-EO, isophthalic acid, and optionally adipic acid (resin H only) each listed in Table 1, and 19.5 g of an esterification catalyst (dibutyltin oxide), and the components were allowed to react at 230° C. for 5 hours, and further at 8.3 kPa for 1 hour. The reaction mixture was cooled to 210° C., and fumaric acid listed in Table 1 and 2 g of hydroquinone were added thereto, and the mixture was allowed to react for 5 hours, and further allowed to react at 8.3 kPa until the reaction mixture reached a desired softening point, to provide each of resins C and H.

Production Example 4 for Resins [Resins E and F]

A 5-liter four-neck flask equipped with a nitrogen inlet tube, a dehydration tube, a stirrer, and a thermocouple were charged with raw material monomers listed in Table 1 and 19.5 g of an esterification catalyst (dibutyltin oxide), and the components were heated to 230° C. and allowed to react until a reaction percentage reached 90%. Thereafter, the reaction mixture was cooled to 185° C., trimellitic anhydride listed in Table 1 was added thereto, the mixture was allowed to react in a stepwise temperature raised to 210° C., and the reaction mixture was further allowed to react at 8.3 kPa until the mixture reached a desired softening point, to provide each of resins E and F.

TABLE 1

| | Linear Polyesters | | | | Cross-Linked Polyesters | |
|---|---|---|---|---|---|---|
| | Resin A | Resin B | Resin C | Resin D | Resin E | Resin F |
| BPA-PO[1)] | 980 g(35) | 2688 g(96) | 980 g(35) | 980 g(35) | 980 g(35) | 2240 g(80) |
| BPA-EO[2)] | 1690 g(65) | — | 1690 g(65) | 1690 g(65) | 1690 g(65) | 520 g(20) |
| 1,4-Butanediol | — | — | — | — | — | — |
| 1,6-Hexanediol | — | — | — | — | — | — |
| Fumaric Acid (FA) | — | 929 g(100) | 279 g(30) | — | — | — |
| Maleic Acid (MA) | — | — | — | — | — | — |
| Isophthalic Acid (IPA) | 1223 g(92) | — | 930 g(70) | — | 1223 g(92) | 1090 g(82) |
| Terephthalic Acid | — | — | — | 1223 g(92) | — | — |
| Adipic Acid | — | — | — | — | — | — |
| Trimellitic Anhydride | — | — | — | — | 123 g(8) | 184 g(12) |
| Content of IPA (% by weight) | 31.4 | 0.0 | 24.0 | 0.0 | 30.5 | 27.0 |
| Content of [FA + MA] (% by weight) | 0.0 | 25.7 | 7.2 | 0.0 | 0.0 | 0.0 |
| Softening Point (° C.) | 109.5 | 101.2 | 110.5 | 111.2 | 127.8 | 141.8 |
| Glass Transition Temperature (° C.) | 63.5 | 61.1 | 60.1 | 65.5 | 73.1 | 71.5 |
| Acid Value (mgKOH/g) | 3.9 | 19.5 | 8.5 | 4.8 | 16.1 | 15.4 |

| | Linear Polyesters | | | |
|---|---|---|---|---|
| | Resin G | Resin H | Resin I | Resin J |
| BPA-PO[1)] | 2688 g(96) | 2800 g(100) | — | — |
| BPA-EO[2)] | — | — | — | — |
| 1,4-Butanediol | — | — | 505 g(70) | — |
| 1,6-Hexanediol | — | — | 284 g(30) | 945 g(100) |
| Fumaric Acid (FA) | — | 371 g(40) | 929 g(100) | — |
| Maleic Acid (MA) | 929 g(100) | — | — | — |
| Isophthalic Acid (IPA) | — | 266 g(20) | — | 1329 g(100) |
| Terephthalic Acid | — | — | — | — |
| Adipic Acid | — | 468 g(40) | — | — |
| Trimellitic Anhydride | — | — | — | — |
| Content of IPA (% by weight) | 0.0 | 6.8 | 0.0 | 58.4 |
| Content of [FA + MA] (% by weight) | 25.7 | 9.5 | 54.1 | 0.0 |
| Softening Point (° C.) | 101.5 | 102.1 | 111 | 125 |
| Glass Transition Temperature (° C.) | 59.8 | 46.8 | Not Observed | Not Observed |
| Acid Value (mgKOH/g) | 18.2 | 6.8 | 6.5 | 9.5 |

Note)
The numerical values inside the parentheses are expressed by molar ratio.
[1)]Propylene oxide adduct of bisphenol A (2.2 mol).
[2)]Ethylene oxide adduct of bisphenol A (2.2 mol).

Examples 1 to 10 and Comparative Examples 1 to 13

One-hundred parts by weight of a resin binder shown in Table 2, 2 parts by weight of a wax "Carnauba Wax No. 1" (commercially available from S. Kato & CO., melting point 81° C.), 3 parts by weight of a charge control agent "T-77" (commercially available from Hodogaya Chemical Co., Ltd.), and 6 parts by weight of a carbon black "NIPEX60" (commercially available from Evonic Degussa Japan Co., Ltd.) were added together, and the components were mixed with a Henschel mixer for 60 seconds. The resulting mixture was melt-kneaded with a twin-screw extruder, the melt-kneaded mixture was cooled, and roughly pulverized with a hammer mill to a size of 1 mm or so. The resulting roughly pulverized product was finely pulverized with an air-jet pulverizer, and the finely pulverized product was classified, to provide negatively chargeable toner matrix particles having a volume-median particle size ($D_{50}$) of 8.5 μm.

One-hundred parts by weight of the resulting toner matrix particles and an external additive listed in Table 2 were mixed with a Henschel mixer for 3 minutes, to provide a toner. The physical properties of the resulting toner are shown in Table 3.

TABLE 2

| | | | Content in Total Amount of Raw Material Monomers of Polyester (% by weight) | | |
|---|---|---|---|---|---|
| | Resin Binders | External Additives | Isophthalic Acid | Fumaric acid + Maleic acid | Isophthalic acid + Fumaric acid + Maleic acid |
| Example 1 | Resin A/Resin B = 70/30 | R972/NAX50 = 0.9/1.0 | 22.0 | 7.7 | 29.7 |
| Example 2 | Resin A/Resin B = 50/50 | R972/NAX50 = 0.9/1.0 | 15.7 | 12.9 | 28.6 |
| Example 3 | Resin A/Resin B = 90/10 | R972/NAX50 = 0.9/1.0 | 28.3 | 2.6 | 30.9 |
| Example 4 | Resin A/Resin B = 70/30 | R974/NAX50 = 0.9/1.0 | 22.0 | 7.7 | 29.7 |
| Example 5 | Resin A/Resin B = 50/50 | R974/NAX50 = 0.9/1.0 | 15.7 | 12.9 | 28.6 |
| Example 6 | Resin A/Resin B = 90/10 | R974/NAX50 = 0.9/1.0 | 28.3 | 2.6 | 30.9 |
| Example 7 | Resin C = 100 | R972/NAX50 = 0.9/1.0 | 24.0 | 7.2 | 31.2 |
| Example 8 | Resin A/Resin G = 70/30 | R972/NAX50 = 0.9/1.0 | 22.0 | 7.7 | 29.7 |
| Example 9 | Resin A/Resin B/Resin D = 50/30/20 | R972/NAX50 = 0.9/1.0 | 15.7 | 7.7 | 23.4 |

TABLE 2-continued

| | Resin Binders | External Additives | Content in Total Amount of Raw Material Monomers of Polyester (% by weight) | | |
|---|---|---|---|---|---|
| | | | Isophthalic Acid | Fumaric acid + Maleic acid | Isophthalic acid + Fumaric acid + Maleic acid |
| Example 10 | Resin A/Resin B/Resin D = 70/10/20 | R972/NAX50 = 0.9/1.0 | 22.0 | 2.6 | 24.6 |
| Comparative Example 1 | Resin B/Resin E = 30/70 | R972/NAX50 = 0.9/1.0 | 21.4 | 7.7 | 29.1 |
| Comparative Example 2 | Resin B/Resin F = 30/70 | R972/NAX50 = 0.9/1.0 | 18.9 | 7.7 | 26.6 |
| Comparative Example 3 | Resin B/Resin D = 70/30 | R972/NAX50 = 0.9/1.0 | 0.0 | 18.0 | 18.0 |
| Comparative Example 4 | Resin B/Resin D = 50/50 | R972/NAX50 = 0.9/1.0 | 0.0 | 12.9 | 12.9 |
| Comparative Example 5 | Resin A/Resin B = 70/30 | UFP-30HH = 1.0 | 22.0 | 7.7 | 29.7 |
| Comparative Example 6 | Resin A/Resin B = 70/30 | R976 = 0.9 | 22.0 | 7.7 | 29.7 |
| Comparative Example 7 | Resin A/Resin B = 30/70 | R972/NAX50 = 0.9/1.0 | 9.4 | 18.0 | 27.4 |
| Comparative Example 8 | Resin A = 100 | R972/NAX50 = 0.9/1.0 | 31.4 | 0.0 | 31.4 |
| Comparative Example 9 | Resin A/Resin B/Resin D = 30/30/40 | R972/NAX50 = 0.9/1.0 | 9.4 | 7.7 | 17.1 |
| Comparative Example 10 | Resin A/Resin B/Resin D = 50/10/40 | R972/NAX50 = 0.9/1.0 | 15.7 | 2.6 | 18.3 |
| Comparative Example 11 | Resin H = 100 | R972/NAX50 = 0.9/1.0 | 6.8 | 9.5 | 16.3 |
| Comparative Example 12 | Resin A/Resin I = 70/30 | R972/NAX50 = 0.9/1.0 | 22.0 | 16.2 | 38.2 |
| Comparative Example 13 | Resin B/Resin D/Resin J = 10/25/65 | — (Unable to be formed into a toner) | 38.0 | 2.6 | 40.6 |

Note)
R972: Commercially available from Nihon Aerosil Co, Ltd., hydrophobic silica, average particle size: 16 nm
R974: Commercially available from Nihon Aerosil Co, Ltd., hydrophobic silica, average particle size: 14 nm
R976: Commercially available from Nihon Aerosil Co, Ltd., hydrophobic silica, average particle size: 7 nm
NAX50: Commercially available from Nihon Aerosil Co, Ltd., hydrophobic silica, average particle size: 50 nm
UFP-30HH: Commercially available from Denki Kagaku Kogyo K.K., hydrophobic silica, average particle size: 120 nm

TABLE 3

| | Physical Properties of Toners | | | | | |
|---|---|---|---|---|---|---|
| | Tm(° C.) | Tg(° C.) | Mn | Mw | Low-Molecular Weight Component (% by weight) Having Molecular Weight of 1,000 or less | G'(Pa) at 50° C. |
| Example 1 | 106.4 | 58.9 | 4,300 | 12,900 | 3.3 | $4.5 \times 10^7$ |
| Example 2 | 103.5 | 56.4 | 4,100 | 12,400 | 3.7 | $3.7 \times 10^7$ |
| Example 3 | 108.1 | 60.1 | 4,400 | 13,000 | 3.4 | $4.3 \times 10^7$ |
| Example 4 | 106.8 | 58.1 | 4,300 | 12,800 | 3.4 | $4.5 \times 10^7$ |
| Example 5 | 103.6 | 56.8 | 4,100 | 12,200 | 3.7 | $3.7 \times 10^7$ |
| Example 6 | 108.9 | 59.8 | 4,400 | 13,100 | 3.4 | $4.3 \times 10^7$ |
| Example 7 | 107.1 | 57.1 | 4,500 | 12,500 | 3.5 | $4.1 \times 10^7$ |
| Example 8 | 107.0 | 57.9 | 4,400 | 13,300 | 3.5 | $4.1 \times 10^7$ |
| Example 9 | 106.4 | 59.8 | 3,900 | 12,700 | 4.0 | $3.9 \times 10^7$ |
| Example 10 | 107.9 | 61.5 | 4,000 | 12,900 | 4.0 | $3.8 \times 10^7$ |
| Comparative Example 1 | 122.4 | 65.5 | 4,200 | 212,000 | 4.4 | $4.5 \times 10^7$ |
| Comparative Example 2 | 132.8 | 65.2 | 3,800 | 446,000 | 4.3 | $1.0 \times 10^8$ |
| Comparative Example 3 | 103.9 | 60.2 | 3,100 | 11,900 | 5.3 | $2.8 \times 10^7$ |
| Comparative Example 4 | 106.8 | 63.5 | 2,800 | 11,500 | 5.9 | $2.5 \times 10^7$ |
| Comparative Example 5 | 106.1 | 58.9 | 4,200 | 12,600 | 3.6 | $4.5 \times 10^7$ |
| Comparative Example 6 | 106.2 | 58.7 | 4,300 | 12,700 | 3.5 | $4.6 \times 10^7$ |
| Comparative Example 7 | 101.5 | 55.0 | 3,600 | 12,800 | 3.9 | $4.3 \times 10^7$ |
| Comparative Example 8 | 110.0 | 61.2 | 4,500 | 13,100 | 3.4 | $3.7 \times 10^7$ |
| Comparative | 106.6 | 60.7 | 3,200 | 11,800 | 5.8 | $3.2 \times 10^7$ |

TABLE 3-continued

| | Physical Properties of Toners | | | | | |
|---|---|---|---|---|---|---|
| | Tm(° C.) | Tg(° C.) | Mn | Mw | Low-Molecular Weight Component (% by weight) Having Molecular Weight of 1,000 or less | G'(Pa) at 50° C. |
| Example 9 | | | | | | |
| Comparative Example 10 | 107.8 | 62.1 | 3,500 | 12,000 | 5.5 | $3.1 \times 10^7$ |
| Comparative Example 11 | 102.1 | 46.8 | 3,800 | 14,100 | 4.4 | $2.6 \times 10^7$ |
| Comparative Example 12 | 98.2 | 36.4 | 3,400 | 11,100 | 4.6 | $2.2 \times 10^7$ |
| Comparative Example 13 | Unable to be formed into a toner | | | | | |

Test Example 1 [Low-Temperature Fixing Ability]

Six parts by weight of the resulting toner and 94 parts by weight of a ferrite carrier (volume-average particle size: 60 μm, saturation magnetization: 68 $Am^2/kg$) were mixed together, to provide a two-component developer.

The resulting two-component developer was loaded on a copy machine "AR-505" (commercially available from Sharp Corporation), and adjustment was made so that the amount of toner would be 0.6 $mg/cm^2$. Thereafter, images at the stage before fixing were taken out to provide unfixed images. The unfixed images were fixed with an external fixing device, a modified fixing device for an apparatus for forming fixed images according to a non-contact fusing method "Vario stream 9000" (commercially available from Oce Printing Systems GmbH) by sequentially raising the temperature on paper from 90° to 150° C., to provide fixed images. "UNICEF Cellophane" tape (commercially available from MITSUBISHI PENCIL CO., LTD., width: 18 mm, JIS Z-1522) was adhered to the fixed images obtained at each fixing temperature, the tape was pressed with a roller so as to apply a load of 500 g, and the tape was then removed. The image densities before and after the removal of the tape were measured. The temperature on paper at which the ratio of the image density after removal of tape/before removal of tape initially exceeds 90% is defined as the lowest fixing temperature. The low-temperature fixing ability was evaluated in accordance with the following evaluation criteria. The lower the lowest fixing temperature, the more excellent the low-temperature fixing ability. Paper used in the fixing test was a paper "Copy Bond SF-70NA" (75 $g/m^2$) commercially available from Sharp Corporation. The results are shown in Table 4.

[Evaluation Criteria]

A: The lowest fixing temperature is lower than 120° C.

B: The lowest fixing temperature is 120° C. or higher and lower than 125° C.

C: The lowest fixing temperature is 125° C. or higher.

Test Example 2 [Transferability and Image Densit]

A two-component developer obtained in the same manner as in Test Example 1 was loaded on an apparatus for forming fixed images according to a non-contact development method "Vario stream 9000" (commercially available from Oce Printing Systems GmbH), and a durability printing test was conducted at a print coverage of 9%, a linear speed of 1,000 mm/sec for 2 hours. Thereafter, a durability printing test was conducted at a printing ratio of 0.15% for 3 hours, the printer was imperatively halted, and the amount of the toner on a photoconductor (To) and the amount of the toner on paper (Tp) were weighed. Defining a value calculated by the formula of Tp/To×100 as the transfer efficiency, the transferability was evaluated in accordance with the following evaluation criteria. The higher the transfer efficiency, the more excellent the transferability. The results are shown in Table 4.

[Evaluation Criteria]

A: The transfer efficiency is 70% or more.

B: The transfer efficiency is less than 70%.

Also, image samples obtained immediately before the hard stop were collected, and the image densities were measured with a colorimeter "GretagMacbeth Spectroeye" (commercially available from GretagMacbeth Co.) at 5 points of the printed portion of the fixed images, and an average was calculated as an image density (ID) to evaluate image densities.

Test Example 3 [Toner Scumming on the Carrier]

A two-component developer obtained in the same manner as in Test Example 1 was loaded on an apparatus for forming fixed images according to a non-contact development method and a two-component development method "Vario stream 9000" (commercially available from Oce Printing Systems GmbH), and a durability printing test was conducted at a printing ratio of 9%, a linear speed of 1,000 mm/sec for 30 hours. Thereafter, the amount of toner scumming on the carrier was measured in accordance with the following method, and durability was evaluated. The smaller the amount of toner scumming on the carrier, the more excellent the durability. The results are shown in Table 4.

(1) A two-component developer is allowed to pass through a mesh having a sieve opening of 20 μm with a vacuum cleaner, and the amount of total organic carbon of the remaining carrier is measured with a total organic carbon analyzer (Carbon Analyzer: commercially available from HORIBA, Ltd.)

(2) The carrier of which amount of total organic carbon is measured in (1) is washed with chloroform, to remove toners adhered to the carrier. After cleaning, the amount of total organic carbon of the carrier is measured.

(3) A value obtained by subtracting the amount of total organic carbon measured in (2) from the amount of total organic carbon measured in (1) is defined as the amount of toner scumming on the carrier. The amount of toner scumming on the carrier is expressed in % by weight to the carrier.

TABLE 4

| | Low-Temperature Fixing Ability [Lowest Fixing Temp. (° C.)] | Transfer-ability [Transfer Efficiency (%)] | Image Density | Durability [Amount of Toner Scumming on the Carrier (% by weight)] |
|---|---|---|---|---|
| Example 1 | A (119) | A (85) | 1.9 | 0.09 |
| Example 2 | A (115) | A (81) | 1.8 | 0.12 |
| Example 3 | B (123) | A (88) | 1.9 | 0.08 |
| Example 4 | B (121) | A (83) | 1.8 | 0.09 |
| Example 5 | A (116) | A (78) | 1.8 | 0.11 |
| Example 6 | B (123) | A (79) | 1.8 | 0.10 |
| Example 7 | A (118) | A (82) | 1.8 | 0.18 |
| Example 8 | A (119) | A (78) | 1.8 | 0.15 |
| Example 9 | B (120) | A (71) | 1.7 | 0.10 |
| Example 10 | B (124) | A (72) | 1.7 | 0.08 |
| Comparative Example 1 | C (129) | A (82) | 1.8 | 0.07 |
| Comparative Example 2 | C (138) | A (83) | 1.8 | 0.05 |
| Comparative Example 3 | A (115) | B (58) | 1.3 | 0.08 |
| Comparative Example 4 | B (122) | B (45) | 1.2 | 0.09 |
| Comparative Example 5 | B (121) | B (51) | 1.3 | 0.08 |
| Comparative Example 6 | A (110) | B (59) | 1.3 | 0.08 |
| Comparative Example 7 | A (110) | A (85) | 1.8 | 0.23 |
| Comparative Example 8 | C (128) | A (82) | 1.8 | 0.08 |
| Comparative Example 9 | B (121) | B (61) | 1.5 | 0.09 |
| Comparative Example 10 | B (124) | B (59) | 1.4 | 0.09 |
| Comparative Example 11 | A (115) | B (53) | 1.3 | 0.25 |
| Comparative Example 12 | A (103) | B (35) | 1.0 | 0.31 |

It can be seen from the above results that the toners of Examples 1 to 10 are excellent in both low-temperature fixing ability and durability, and maintain favorable transfer efficiencies and image densities even when a durability printing is carried out at a low printing ratio, as compared to the toners of Comparative Examples 1 to 12.

Incidentally, when the toners of Examples 1 to 10 were used in an apparatus for forming fixed images according to a contact fusing method "AR-S330" (commercially available from Sharp Corporation), hot offset was generated, so that the toners could not be used for a contact fusing method.

The toner for non-contact fusing of the present invention is suitably used in developing latent images formed in, for example, electrophotography, an electrostatic recording method, an electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for non-contacting fusing comprising (a) toner matrix particles comprising a resin binder and (b) an external additive having an average particle size of from 10 to 100 nm, wherein the external additive is externally added to the toner matrix particles, wherein the resin binder comprises one or more polyesters including a polyester C, wherein a carboxylic acid component of the polyester C comprises (i) one or more isophthalic acid compounds selected from the group consisting of isophthalic acid and esters thereof and (ii) one or more fumaric acid/maleic acid compounds selected from the group consisting of fumaric acid, maleic acid, maleic anhydride, and esters thereof, wherein the isophthalic acid compound is contained in an amount of from 10 to 35% by weight, the fumaric acid/maleic acid compound is contained in an amount of from 1 to 15% by weight, and the isophthalic acid compound and the fumaric acid/maleic acid compound are contained in a total amount of from 20 to 36% by weight, of the total amount of the entire raw material monomers of the polyesters in the resin binder, wherein the toner has a softening point of from 90° to 120° C., and wherein polyester C has a softening point of from 90° to 120° C., obtained by polycondensing an alcohol component and a carboxylic acid component comprising 70% to 83.3 mol % of the isophthalic acid compound and 20 to 43 mol of the fumaric acid/maleic acid compound, based on 100 mol of the isophthalic acid compound.

2. The toner according to claim 1, wherein a low-molecular weight component having a molecular weight of 1000 or less contained in a tetrahydrofuran-soluble component of the toner is contained in an amount of 4.0% by weight or less.

3. The toner according to claim 1, wherein a tetrahydrofuran-soluble component of the toner has a number-average molecular weight of from 2000 to 5000, and a weight-average molecular weight of from 8000 to 15000.

4. The toner according to claim 1, wherein the alcohol component comprises a propylene oxide adduct of bisphenol A.

5. The toner according to claim 1, wherein the external additive is a combination of an external additive having an average particle size of from 10 nm or more and less than 30 nm and an external additive having an average particle size of from 30 to 100 nm.

6. The toner according to claim 1, which has a storage modulus G' at 50° C. in a frequency of 6.28 rad/s of from $3.0\times10^7$ to $3.0\times10^8$ Pa.

7. The toner according to claim 1, which additionally comprises negatively chargeable charge control agent comprising a metal-containing azo dye.

8. The toner according to claim 1, which has a softening point of from 100 to 110° C.

9. The toner according to claim 1, wherein the polyester C is contained in a total amount of from 70 to 100% by weight of the resin binder.

10. The toner according to claim 1, wherein the polyester C is contained in a total amount of substantially 100% by weight of the resin binder.

11. The toner according to claim 1, wherein the external additive having an average particle size of from 10 nm to 100 nm is contained in an amount of from 0.1 to 5 parts by weight based on 100 parts by weight of the toner matrix particles.

12. The toner according to claim 1, wherein the resin binder does not contain a nonlinear polyester.

13. The toner according to claim 1, wherein the polyester C is a linear polyester.

14. The toner according to claim 1, wherein the polyester C has a softening point of from 95° to 115° C.

15. The toner according to claim 1, wherein the polyester C has a softening point of from 100° to 110° C.

* * * * *